US009696107B1

(12) United States Patent
Kempf et al.

(10) Patent No.: US 9,696,107 B1
(45) Date of Patent: Jul. 4, 2017

(54) MULTI-ELEMENT ONE PIECE CROSSBOW FRAME

(71) Applicants: James J. Kempf, Coralville, IA (US); Rex E. Isenhower, Stanwood, IA (US)

(72) Inventors: James J. Kempf, Coralville, IA (US); Rex E. Isenhower, Stanwood, IA (US)

( * ) Notice: Subject to any disclaimer, the term of this patent is extended or adjusted under 35 U.S.C. 154(b) by 0 days.

(21) Appl. No.: 14/940,822

(22) Filed: Nov. 13, 2015

(51) Int. Cl.
*F41B 5/12* (2006.01)

(52) U.S. Cl.
CPC ..... *F41B 5/123* (2013.01); *F41B 5/12* (2013.01)

(58) Field of Classification Search
CPC ..... F41B 5/12; F41B 5/123
See application file for complete search history.

(56) References Cited

U.S. PATENT DOCUMENTS 7,258,113 B2 8/2007 Pilpel et al.
8,720,424 B2 * 5/2014 Kempf ..... F41B 5/10 124/25
8,807,125 B1 8/2014 Mathur et al.
9,032,946 B1 * 5/2015 Mathur ..... B29C 45/0005 124/23.1
9,328,987 B2 * 5/2016 Bednar ..... F41B 5/0084
2015/0159975 A1 * 6/2015 Darlington ..... F41B 5/12 124/25

* cited by examiner

*Primary Examiner* — John Ricci
(74) *Attorney, Agent, or Firm* — Donald J. Ersler

(57) ABSTRACT

A multi-element one piece reverse draw style crossbow frame preferably includes a riser element, an AR style stock receiver tube element, a barrel element, a foot stirrup element, a first limb pocket element and a second limb pocket element, which are molded as a single piece of material. A first limb and a second limb are attached to the riser element. A first cam is pivotally retained on a distal end of the first limb and a second cam is pivotally retained on a distal end of a second limb. The barrel element preferably includes an opening for a trigger box, stock mounting points, an integrated finger guard, accessory mounting points and the like. A multi-element one piece dual stirrup crossbow frame preferably includes a barrel element, a riser element, a first foot stirrup element and a second foot stirrup element, which are molded as a single piece of material.

25 Claims, 6 Drawing Sheets

MULTI-ELEMENT ONE PIECE CROSSBOW FRAME

BACKGROUND OF THE INVENTION

1. Field of the Invention

The present invention relates generally to archery and more specifically to a multi-element one piece crossbow frame, which includes a riser and a barrel fabricated from a single piece of material.

2. Discussion of the Prior Art

It is a common product design goal to improve or replace conventional items with items having improved characteristics, such as improvements in strength, rigidity and durability, material qualities and economic concerns. One industry where such enhancements are being made is the crossbow industry. Crossbows have multiple elements, such as a trigger assembly; a bow assembly, which may include a bow riser, limbs, cams and a string and cable set; a frame, which may include a barrel, also known as a flight rail, a foot stirrup; and a stock assembly. The bow assembly is generally attached to the frame assembly, and the trigger assembly is generally inserted into the frame assembly. Some of the base elements of the assemblies typically consist of a bow riser, limb pockets, barrel, and stirrup, that when joined together, form what can be called a crossbow frame. Typically, some sort of mechanical fastening is used to join the elements of the crossbow frame together, which may cause unwanted stress on the connection points. Stresses of varying magnitude and orientation develop within the crossbow frame during use. Stresses can also develop within the frame components during the manufacturing process.

One example of prior art is U.S. Pat. No. 7,258,113 to Pilpel et al., which teaches an archery riser formed from a fibrous composite material, and which may incorporate a spine formed from a different material than the rest of the riser. This method may also include a near net shape, which requires additional machining to achieve the final desired shape. Though this method achieves its desired goal, these methods can be improved upon.

Another example of prior art is U.S. Pat. No. 8,807,125 Mathur, et al, which teaches a three dimensionally fiber reinforced composite riser and methods of making the same. U.S. Pat. No. 8,807,125 is hereby incorporated by reference into this application in its entirety. This method for manufacturing a crossbow riser is ideal. However, Mather et al. is limited to the scope of a crossbow riser, which may or may not include the limb pockets. Whether utilizing a riser machined from a near net shape composite, or a riser made of a three dimensionally reinforced composite, mechanical fasteners are still required to join the riser with other components of the crossbow frame. These fastening points create weakness, and a potential source of noise and vibration, caused from multiple surface irregularities and imperfections. Additionally, all of these other components of the crossbow frame each require their own tooling and manufacturing process.

Accordingly, there is a clearly felt need in the art for a exists a need for a multi-element one piece crossbow frame, which is created in mold, from a three dimensional fiber-reinforced composite.

SUMMARY OF THE INVENTION

The present invention provides a multi-element one piece crossbow frame, which includes a riser and a barrel fabricated from a single piece of material. In a crossbow, the riser has an interior support with opposed side members and a front brace. The front brace has a depression centrally located therein. Two side ribs are also provided for structural support. Two pockets each optionally having a divider wall defining a top and bottom section are provided for receiving respective top and bottom pieces of a split limb, when a split limb is used. The barrel and riser element are blended into a unitary piece, each adding to the strength of the other. The multi-component crossbow frame can be made of a composite material having fibers aligned with the directions of the highest stresses for enhancing the structural strength of the riser. Other crossbow elements or components, such as the stirrup, butt stock, and the like, can likewise be incorporated with the frame as well.

According to one advantage of the present invention, the multi-element one piece crossbow frame can be formed from a single unitary piece of composite material thereby reducing the number of manufacturing steps and the number of secondary parts produced. For example, mounting features for quivers, specialized grips, limb attachment, stock attachment and the like may be incorporated into the present invention without the need for secondary manufacturing operations. Several components can be consolidated via the present invention leading to structural and economic advantages.

Accordingly, the economic considerations of manufacturing are enhanced by the method of the present invention.

According to another advantage of the present invention, the multi-element one piece crossbow frame is made of a composite material without the need for a spine or other structural enhancing component. To the contrary, the required material properties are provided as a result of the design and manufacturing of the multi-element one piece crossbow frame of the present invention.

A related advantage provided by the multi-component one piece crossbow frame is the risks of delamination are elinated by the one piece design.

According to another advantage of the present invention, the fibers are advantageously positioned and oriented in all three dimensions and the respective surfaces. The multi-component crossbow frame is designed to absorb the stresses applied to it, both during use and manufacturing. In this regard, fibers can wrap into the intricate and/or curvaceous portions of the riser, where structural demands may be the greatest.

According to a further advantage of the present invention, the multi-element one piece crossbow frame is formed in a single molding process instead of being machined. This advantageously provides many advantages including the elimination of fiber pullouts and exposed fibers, both of which can lead to premature failure. To the contrary, the structural integrity of the present invention is enhanced during the manufacturing process as the fibers remain intact. P reselected orientation and quantity of fibers that remain intact advantageously lead to products meeting desired structural goals.

Further related advantages include elimination of residual stresses from a traditional machining process, as the machining process itself is eliminated in the preferred method of making the present invention.

According to a further advantage of the present invention, the surfaces of the multi-element one piece crossbow frame may be uniform and smooth (or have any desired surface characteristics), and may be a relatively low friction surface. This allows an arrow to behave in a predictable and favorable manner at launch.

A lower cost alternative to a body of a three dimensional unitary structure long fibers formed in a one step process, would be the use of a high strength composite such as carbon filled nylon and the like.

Other advantages, benefits and features of the present invention will become apparent to those skilled in the art upon reading the detailed description of the invention and studying the drawings.

DETAILED DESCRIPTION OF THE PREFERRED EMBODIMENTS

While the invention will be described in connection with several preferred embodiments, it will be understood that it is not intended to limit the invention to those embodiments. On the contrary, it is intended to cover all alternatives, modifications and equivalents as may be included within the spirit of the scope of the invention as described by the appended claims.

Figure 1:
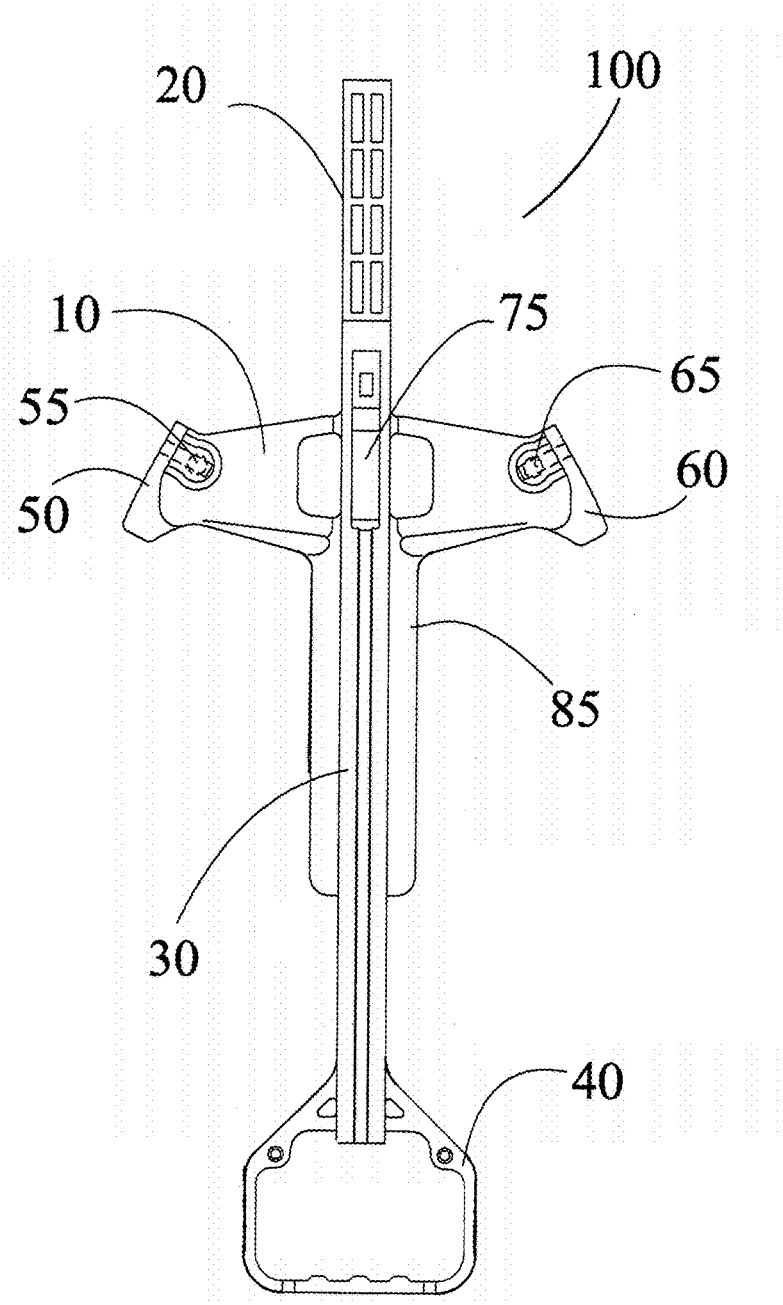
FIG. 1 is a top view of a multi-element one piece reverse draw style crossbow frame of the present invention.

With reference now to the drawings, and particularly to FIG. 1, there is shown a top view of a multi-element one piece cross bow 100. With reference to FIGS. 1A-3, the multi-element one piece crossbow frame 100 includes a riser element 10, an AR style stock receiver tube element 20, a barrel element 30, a foot stirrup element 40, a first limb pocket element 50 and a second limb pocket element 60, which are molded from as a one piece unit. Preferably, the multi-element one piece crossbow frame 100 would be molded with as many crossbow elements as possible. However, the molding of just a riser element 10 and a barrel element 30 add significantly to the strength of the overall crossbow.

Figure 1A:
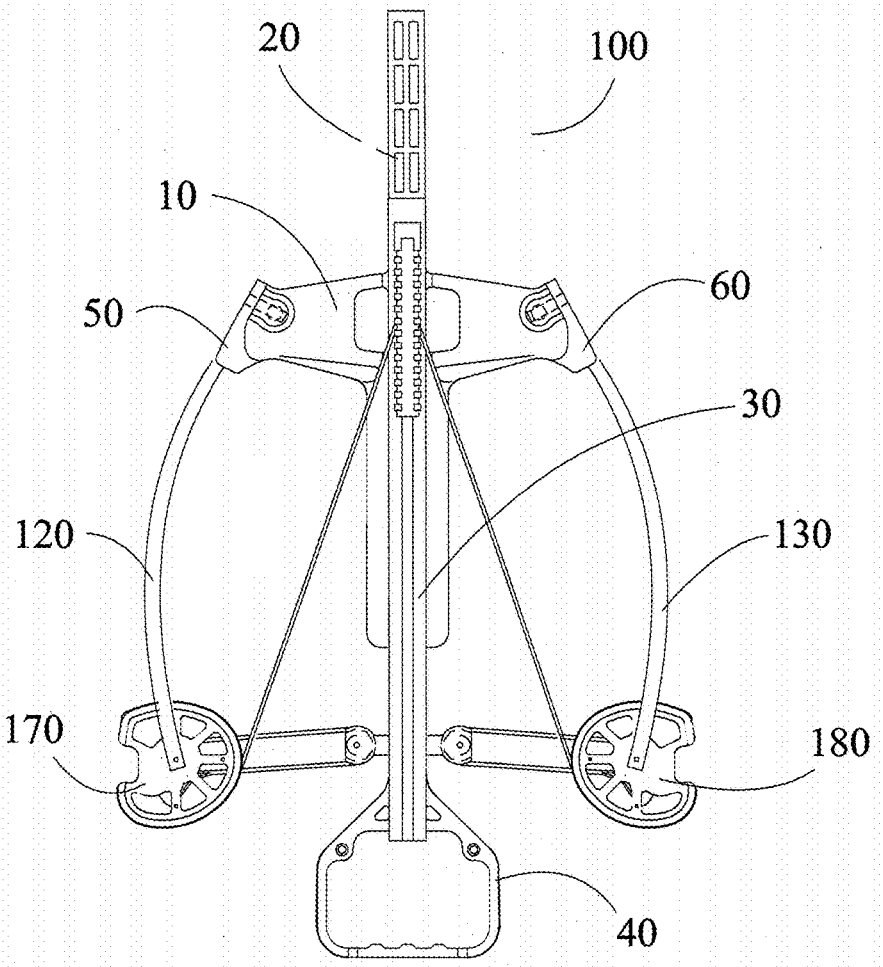
FIG. 1A is a top view of a multi-element one piece reverse draw style crossbow.
Figure 2:
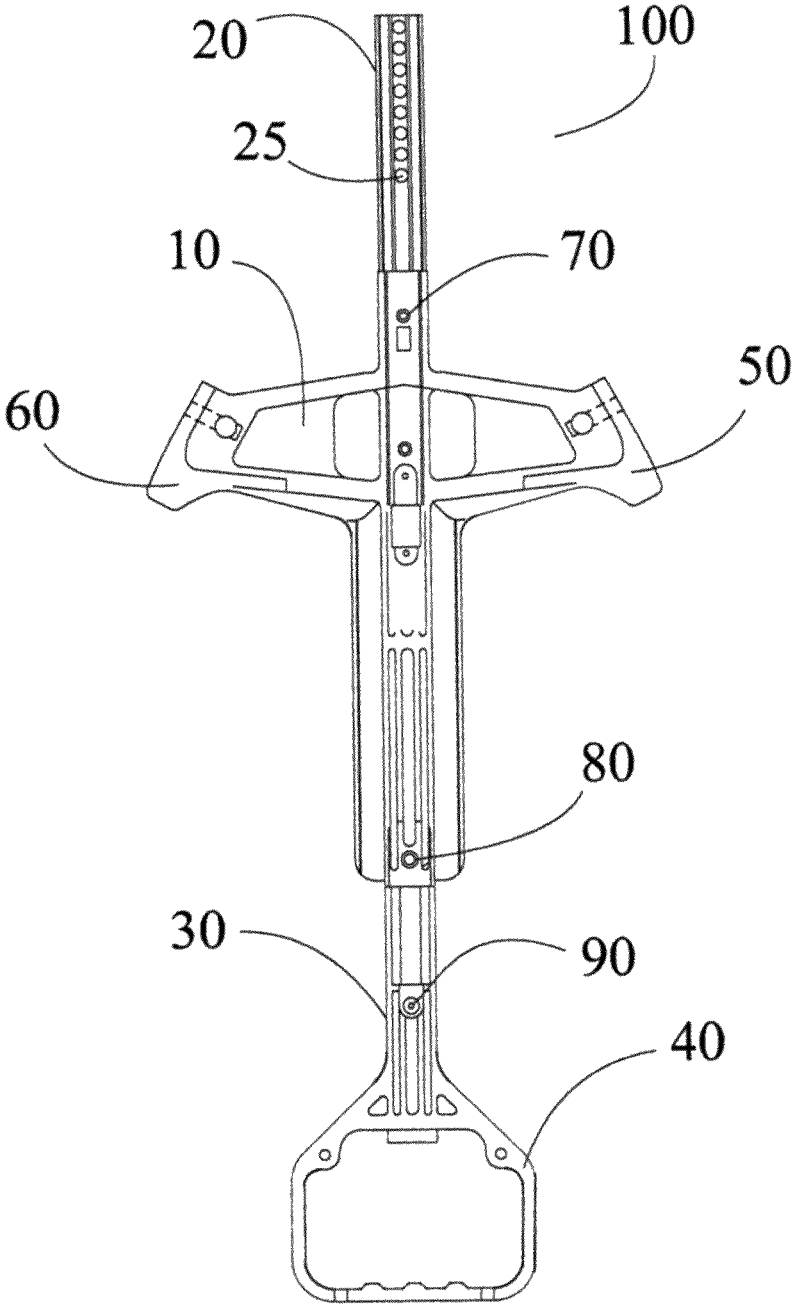
FIG. 2 is a bottom view of a multi-element one piece reverse draw style crossbow.
Figure 3:
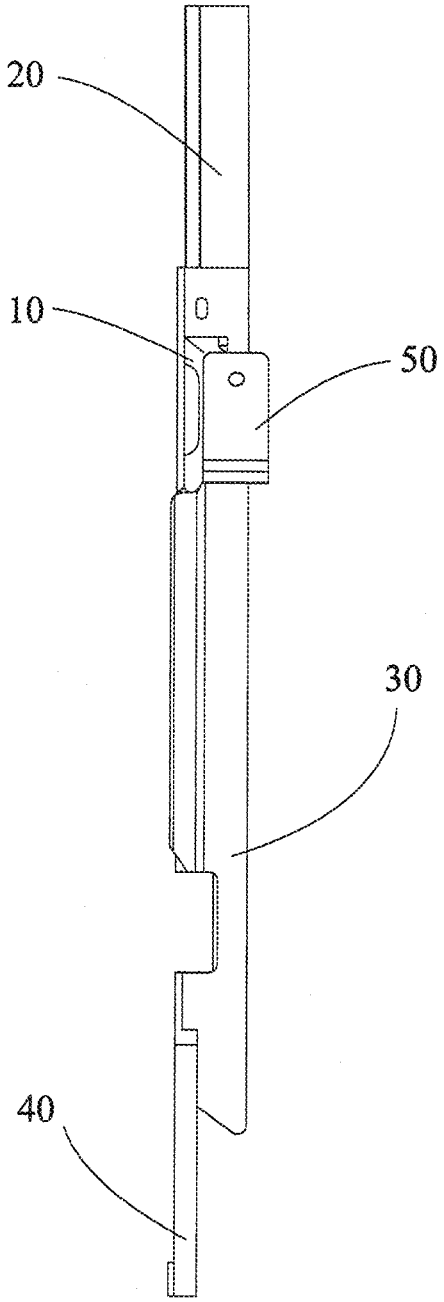
FIG. 3 is a side view of a multi-element one piece reverse draw style crossbow frame of the present invention.

FIG. 1A illustrates a first limb 120 and a second limb 130 attached to the riser element 10; a first cam 170 pivotally retained on a distal end of a first limb 120; and a second cam 180 pivotally retained on a distal end of a second limb 130. With reference to FIG. 2, the barrel element 30 preferably includes an opening for the trigger box 75, stock mounting points 80, an integrated finger guard 85, accessory mounting points 90 and the like. The riser element 10 preferably includes a first mounting element 55 for a first limb 120 and a second mounting element 65 for a second limb 130, such as molded in inserts. The riser element 10 may also include an integrated first limb pocket element 50 and an integrated second limb pocket element 60. The AR style stock receiver tube element 20 may have multiple stock stop location pockets 25. An AR style stock may be attached to the AR style stock receiver tube element 20, and function in the way any conventional AR stock functions.

The rear end of the barrel element 30 may not include an integrated AR style stock receiver tube element 20. In the event the multi-element one piece crossbow frame 100 is molded without the AR style stock receiver tube element 20, an alternative embodiment may be a barrel element 30 with a threaded rear end. An aftermarket AR stock tube could be inserted in the rear end of the barrel element, or an alternative embodiment may be a more traditional style crossbow stock attached to the rear end of the barrel element. The foot stirrup element 40 is preferably formed as a unitary piece of the barrel element 30.

Figure 4:
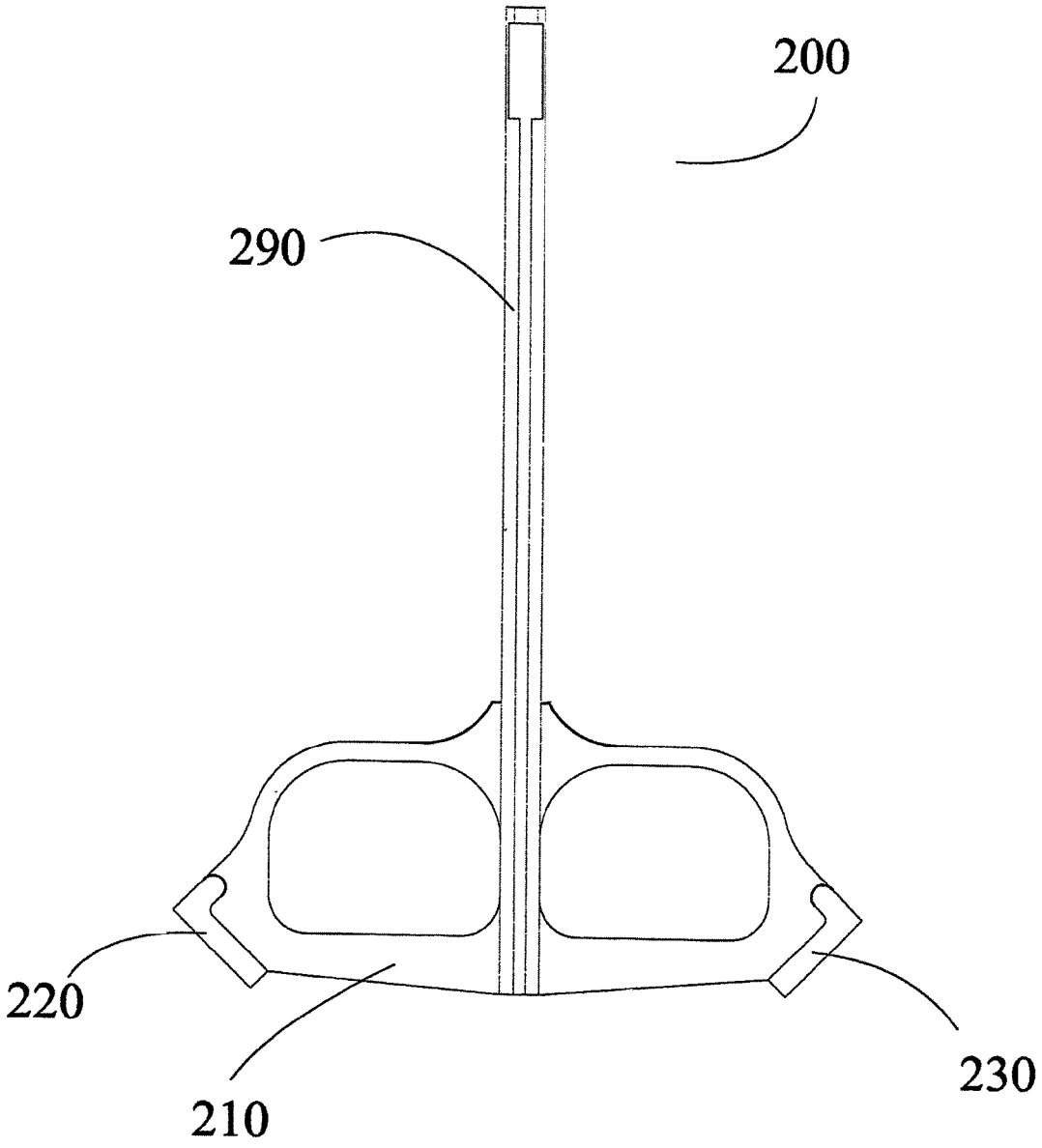
FIG. 4 is a top view of multi-element one piece dual stirrup style crossbow frame of the present invention.
Figure 4A:
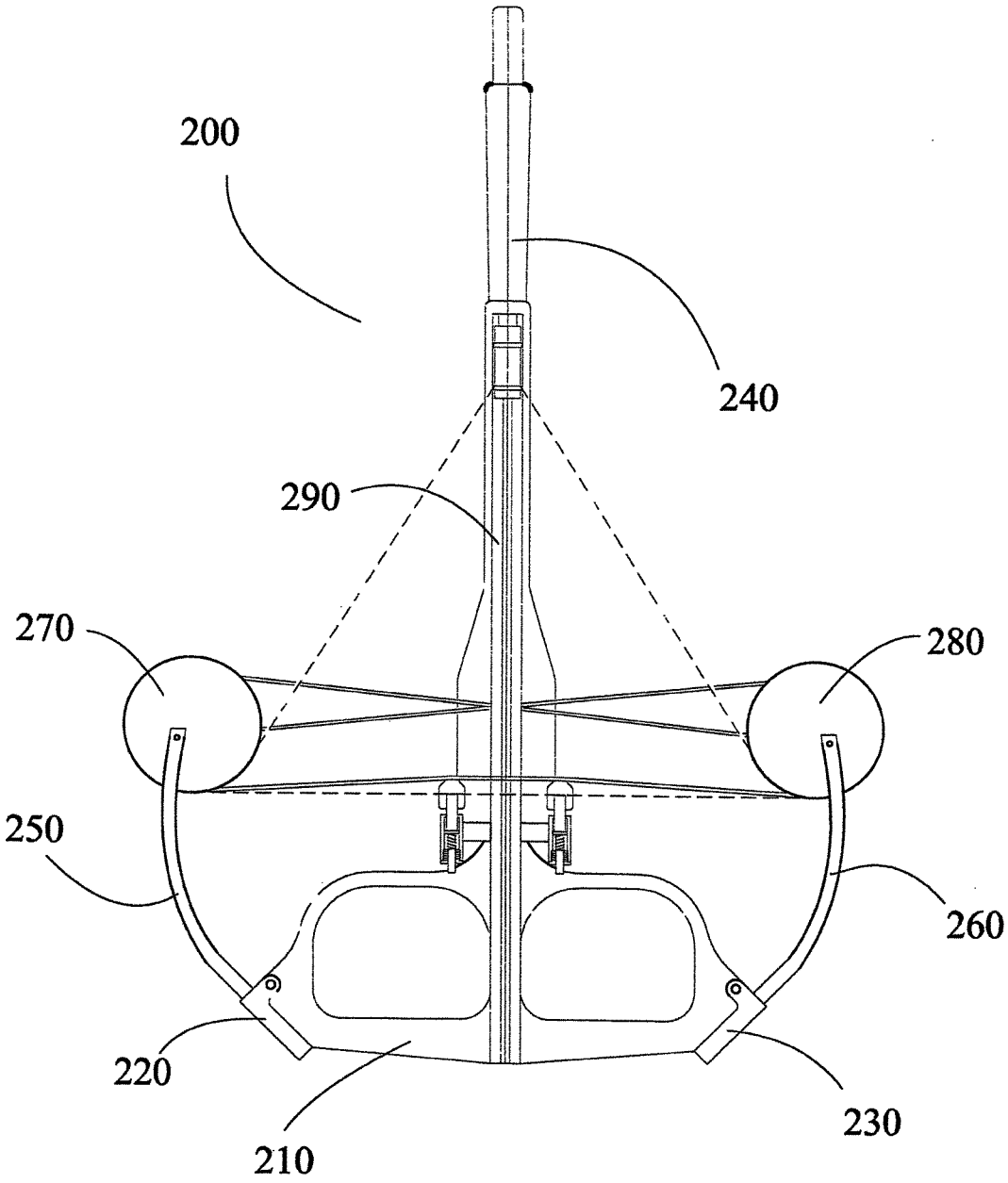
FIG. 4A is a top view of multi-element one piece dual stirrup style crossbow.

FIG. 4 shows a top view of a multi-element one piece dual stirrup style crossbow frame 200, where a first foot stirrup element 212 and a second foot stirrup element 214 are molded as a unitary piece of the riser element 210. A barrel element 290 is preferably molded as a unitary piece of the riser element 210. FIG. 4A shows a top view of a multi-element one piece dual stirrup style crossbow where a first limb 220 and a second limb 230 are attached to the riser element 210. A first cam 270 is pivotally retained on a distal end of a first limb 220, and a second cam 280 is pivotally retained on a distal end of a second limb 230. A stock element 240 may be integrated to the barrel element 290 with molding.

When choosing materials with which to manufacture the present invention, a resin is selected from one of the following: Nylon; Polyurethane; PPS; PES; PEI; Epoxy; and Polyester. Selected amounts of fibers are selected from a group of: E-Glass; S-Glass; Aramid; and Carbon. Selected amounts of fibers are long fibers having a length greater than or equal to 1 mm, and long fibers have a length greater than or equal to 3 mm and less than 25 mm.

When manufacturing the present invention, the preferred method is injection molding, wherein said injection molding has an injection temperature of between 280 to 350 degrees Celsius, a mold temperature of between 90 and 180 degrees Celsius, an injection speed between 50 and 77 mm/sec., and has injection back pressure of between 25 and 50 psi. This method of manufacture, and choice of these type materials allow for a finished product of the present invention that is free or relatively free of exposed fibers, and also provides for the proper orientation of said fibers within the finished product of the present invention. Proper alignment of the fibers is directly relative the strength of the component, as well as contributing to a desired surface texture, or lack thereof, of the finished product of the current invention.

There are many other possible configurations of the present invention, such as a conventional style crossbow, one without a dual stirrup, wherein the riser may be integrated with the front of the barrel, and a foot stirrup may be integrated with the riser/barrel frame, as well as any other crossbow frame configuration known in the art.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. A multi-element one piece crossbow frame comprising:

a barrel having a forward end, a mid-point and a stock end;

a riser extending from said barrel as an integral portion thereof, said riser is disposed between said mid-point and said stock end, wherein said barrel and said riser being formed in an injection molding process using a mold and deriving full structural integrity internally without a spine to form a body, said body having a body top, a body bottom, a body front and a body back, and a body surface, said body comprising a selected amount of fibers three dimensionally arranged in a preselected manner and in a preselected and variable density within said body as a result of a flow of said selected amounts of fibers and a resin within the mold, said resin having a liquid form and a solid form, wherein said selected amounts of fibers being fully embedded within said body thereby preventing an amount of fiber pullouts and an amount of exposed fibers and said selected amount of fibers have an orientation, said orientation of said selected amounts of fibers within said body being constrained only by said resin when said resin is in said solid form; and said body surface has a plurality of body surface characteristics that are independent of said preselected manner and said preselected and variable density of said selected amounts of fibers, at least some of said selected amounts of fibers being flowed and wrapped to create a plurality of pockets when said resin is in a liquid form.

2. The multi-element one piece crossbow frame of claim 1, further comprising:

at least one of two limb pockets, a foot stirrup, a butt stock, a butt stock mounting tube and a stock, wherein said barrel, said riser and said at least one of said two limb pockets, a foot stirrup, a butt stock, a butt stock mounting tube and a stock being formed in an injection molding process using a mold.

3. The multi-element one piece crossbow frame of claim 1 wherein:

said selected amounts of fibers are long fibers having a length greater than or equal to 1 mm.

4. The multi-element one piece crossbow frame of claim 1 wherein:

said long fibers have a length greater than or equal to 3 mm and less than 25 mm.

5. The multi-element one piece crossbow frame of claim 1 wherein:

said selected amounts of fibers are selected from a group of: E-Glass; S-Glass; Aramid; and Carbon.

6. The multi-element one piece crossbow frame of claim 1 wherein:

said resin is at least one of Nylon, Polyurethane, PPS, PES, PEI, Epoxy and Polyester.

7. The multi-element one piece crossbow frame of claim 1 wherein:

said injection molding has an injection temperature of between 280 to 350 degrees Celsius.

8. The multi-element one piece crossbow frame of claim 1 wherein:

said injection molding has a mold temperature of between 90 and 180 degrees Celsius.

9. The multi-element one piece crossbow frame of claim 1 wherein:

said injection molding comprises an injection speed between 50 and 77 mm/sec.

10. The multi-element one piece crossbow frame of claim 1 wherein:

said injection molding has injection back pressure of between 25 and 50 psi.

11. The multi-element one piece crossbow frame of claim 1 wherein a plurality of crossbow accessories are mounted to said multi-element one piece crossbow.

12. A multi-element one piece reverse draw style crossbow frame comprising:

a body of a three dimensional unitary structure formed in a one step, automated industrial composite manufacturing technique that is an injection molding process using a mold and deriving full structural integrity internally without a spine, said body having a body top, a body bottom, a body front and a body back, and a body surface;

said body includes a barrel and a riser, said riser extending from said barrel as an integral portion thereof, said barrel having a forward end, a mid-point and a stock end, said riser is disposed between said mid-point and said stock end; and said body includes selected amount of fibers three dimensionally arranged in a preselected manner and in a preselected and variable density within said body as a result of a flow of said selected amounts of fibers and a resin within the mold, said resin having a liquid form and a solid form, wherein said selected amounts of fibers being fully embedded within said body thereby preventing an amount of fiber pullouts and an amount of exposed fibers, and said selected amount of fibers have an orientation, said orientation of said selected amounts of fibers within said body being constrained only by said resin when said resin is in said solid form; said body surface has a plurality of body surface characteristics that are independent of said preselected manner and said preselected and variable density of said selected amounts of fibers.

13. The multi-element one piece reverse draw style crossbow frame of claim 12 wherein:

said body includes two limb pockets, said two limb pockets being adapted to receive two crossbow limbs, at least some of said selected amounts of fibers being flowed to and wrap around said two limb pockets when said resin is in a liquid form.

14. The multi-element one piece reverse draw style crossbow frame of claim 13 wherein:

at least one of said two limb pockets, a foot stirrup, a butt stock, a butt stock mounting tube and a stock, wherein said barrel, said riser and said at least one of said two limb pockets, a foot stirrup, a butt stock, a butt stock mounting tube and a stock being formed in an injection molding process using the mold.

15. The multi-element one piece reverse draw style crossbow frame of claim 13 wherein:

said selected amounts of fibers are long fibers having a length greater than or equal to 1 mm.

16. The multi-element one piece reverse draw style crossbow frame of claim 13 wherein:

said long fibers have a length greater than or equal to 3 mm and less than 25 mm.

17. The multi-element one piece reverse draw style crossbow frame of claim 13 wherein:

said selected amounts of fibers are selected from a group of: E-Glass; S-Glass; Aramid; and Carbon.

18. The multi-element one piece reverse draw style crossbow frame of claim 13 wherein:

said resin is selected from one of the following: Nylon; Polyurethane; PPS; PES; PEI; Epoxy; and Polyester.

19. The multi-element one piece reverse draw style crossbow frame of claim 13 wherein:

said injection molding has an injection temperature of between 280 to 350 degrees Celsius.

20. The multi-element one piece reverse draw style crossbow frame of claim 13 wherein:

said injection molding has a mold temperature of between 90 and 180 degrees Celsius.

21. The multi-element one piece reverse draw style crossbow frame of claim 13 wherein:

said injection molding comprises an injection speed between 50 and 77 mm/sec.

22. The multi-element one piece reverse draw style crossbow frame of claim 13 wherein:

said injection molding has injection back pressure of between 25 and 50 psi.

23. The multi-element one piece crossbow frame of claim 13 wherein a plurality of crossbow accessories are mounted to said multi-element one piece crossbow.

24. A multi-element one piece reverse draw style crossbow frame comprising:

a barrel having a forward end, a mid-point and a stock end; and a riser extending from said barrel as an integral portion thereof, said riser is disposed between said mid-point and said stock end, wherein said barrel and said riser being formed in an injection molding process using a mold.

25. The multi-element one piece reverse draw style crossbow frame of claim 24, further comprising:

at least one of two limb pockets, a foot stirrup, a butt stock, a butt stock mounting tube and a stock, wherein said barrel, said riser and said at least one of said at least two limb pockets, a foot stirrup, a butt stock, a butt stock mounting tube and a stock being formed in an injection molding process using the mold.

* * * * *